United States Patent [19]

Inamura

[11] Patent Number: 4,524,493

[45] Date of Patent: Jun. 25, 1985

[54] WATERTIGHT SLIDE FASTENER

[75] Inventor: Akio Inamura, Nyuzen, Japan

[73] Assignee: Yoshida Kogyo K. K., Tokyo, Japan

[21] Appl. No.: 498,519

[22] Filed: May 26, 1983

[30] Foreign Application Priority Data

May 26, 1982 [JP] Japan ..... 57-77258[U]

[51] Int. Cl.[3] ..... A44B 19/32

[52] U.S. Cl. ..... 24/389

[58] Field of Search ..... 24/205.1 R, 205.11 R

[56] References Cited

U.S. PATENT DOCUMENTS

| | | | |
|---|---|---|---|
| 2,494,249 | 1/1950 | Krupp | 24/205.1 R |
| 2,535,391 | 12/1950 | Clarke | 24/205.1 R X |
| 2,753,609 | 7/1956 | Gossner | 24/205.1 R |
| 2,800,699 | 7/1957 | Armstrong | 24/205.1 R |
| 2,841,851 | 7/1958 | Amburg et al. | 24/205.1 R |
| 3,409,953 | 11/1968 | Briscoe | 24/205.1 R |
| 3,990,130 | 11/1976 | Hattori | 24/205.1 R |

FOREIGN PATENT DOCUMENTS 53-42161 10/1978 Japan .

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A watertight slide fastener comprises a resilient bifurcated seal member mounted on opposite stringer tapes adjacent to one end of a pair of rows of coupling elements and snugly receivable in a Y-shaped guide channel in a slider body. The seal member has a pair of resilient tongues extending from said one end of the rows of coupling elements along opposed inner longitudinal edges of the stringer tapes and a head interconnecting the tongues at their upper end so as to define therebetween a first slot or facing opening toward said one end of the rows of coupling elements and snugly receptive of a neck of the slider body when the slider is in its uppermost position. The tongues have outer sidewalls sealingly engageable with side flanges of the slider body and opposed inner sidewalls sealingly engageable together when the slider is in the uppermost position.

9 Claims, 7 Drawing Figures

WATERTIGHT SLIDE FASTENER

BACKGROUND OF THE INVENTION

1. Field of the Invention

The present invention relates to slide fasteners, and more particularly to a watertight slide fastener.

2. Prior Art

There have been proposed many watertight slide fasteners comprising a pair of opposed waterproof stringer tapes and seal means for protection against water leakage between intermeshing rows of coupling elements mounted by extrusion molding on the respective stringer tapes along their inner longitudinal edges. Each stringer tape is composed of a woven or knit web having face and back layers of elastomer such as natural or synthetic rubber, and a sealing fin projecting from the longitudinal tape edge toward the coupling heads of companion coupling elements. When the slide fastener is closed and immersed in water, the sealing fins are brought into contact with the coupling heads, thereby hermetically sealing the intermeshing coupling elements against water leakage. In such slide-fastener closed position, those coupling elements received in a slider body, and the endmost coupling elements in particular, are however held out of mutual coupling engagement with each other with the result that water might pass through a space between the endmost coupling elements, thereby impairing watertightness of the slide fastener.

SUMMARY OF THE INVENTION

A watertight slide fastener comprises a resilient bifurcated seal member mounted on opposite stringer tapes adjacent to one end of a pair of rows of coupling elements and snugly receivable in a Y-shaped guide channel in a slider body. The seal member has a pair of resilient tongues extending from said one end of the rows of coupling elements along inner longitudinal edges of the stringer tapes and a head interconnecting the tongues at their upper end so as to define therebetween a first slot or opening facing toward said one end of the rows of coupling elements and snugly receptive of a neck of the slider body when the slider is in its uppermost position. The tongues have outer sidewalls sealingly engageable with side flanges of the slider and opposed inner sidewalls sealingly engageable together when the slider is in the uppermost position.

It is an object of the present invention to provide a watertight slide fastener which is protected against water leakage particularly between coupling elements received in a slider body when the fastener is fully closed.

Another object of the present invention is to provide a watertight slide fastener in which opposed rows of coupling elements are held into mutual coupling engagement together throughout the length thereof in the closed fastener position.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
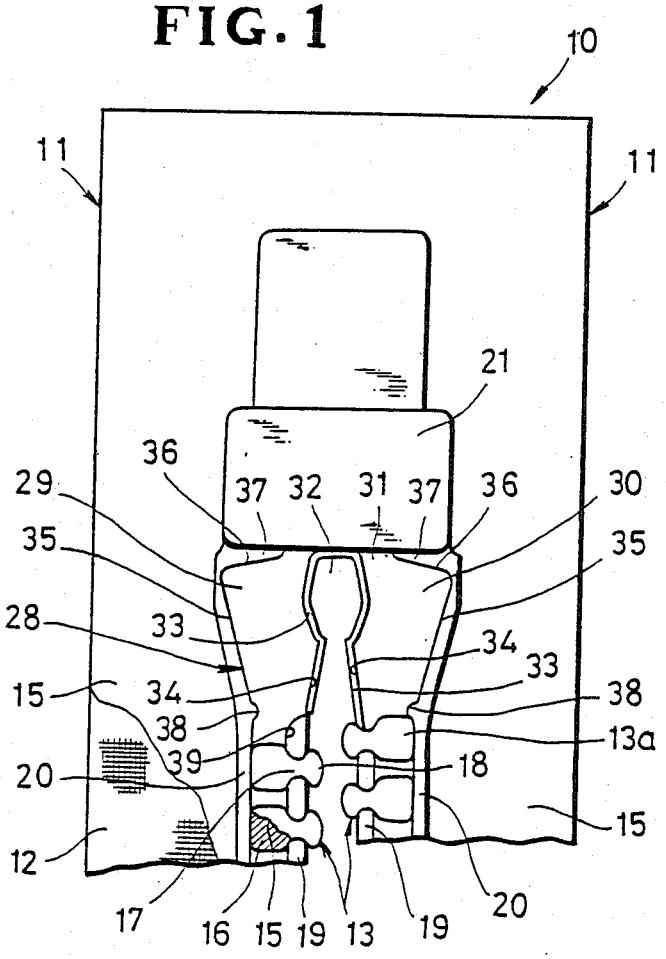
FIG. 1 is a fragmentary plan view, partly broken away, of a watertight slide fastener according to the present invention, the fastener being shown in an open disposition.
Figure 2:
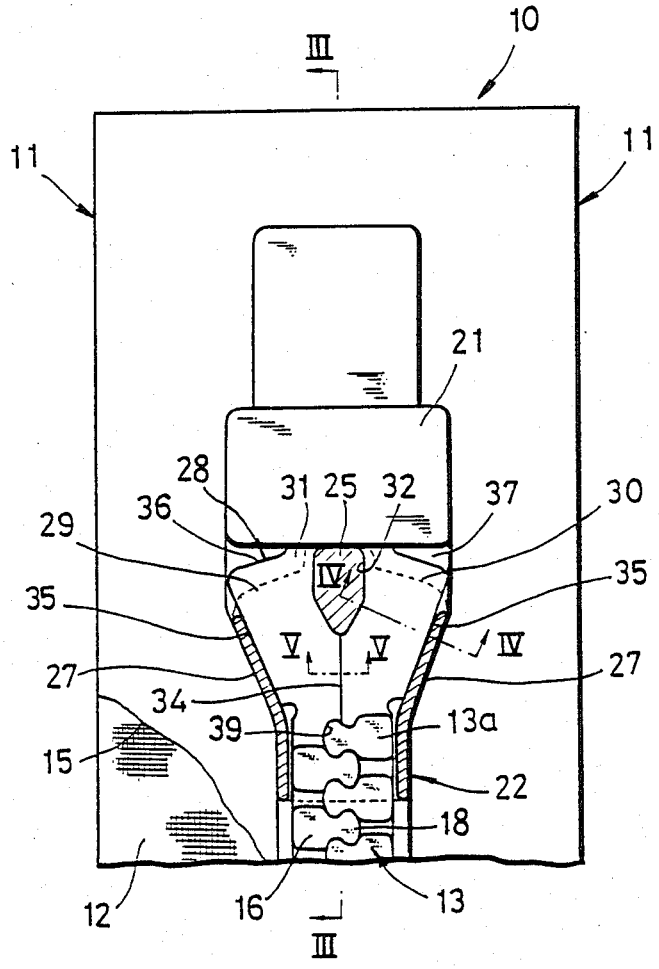
FIG. 2 is a view similar to FIG. 1, showing the fastener in a closed disposition.

The present invention is particularly useful when embodied in a watertight slide fastener generally designated by the reference numeral 10 in FIGS. 1 and 2.

Figure 4:
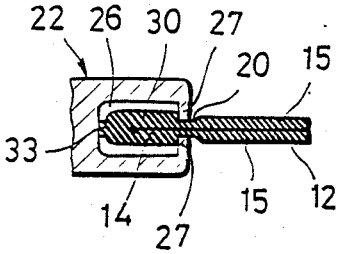
FIG. 4 is an enlarged cross-sectional view taken along line IV—IV of FIG. 2.

The slide fastener 10 includes a pair of identical waterproof stringers 11,11 each having a woven or knit stringer tape 12, a row of discrete coupling elements 13 mounted on the stringer tape 12 along an inner longitudinal edge 14 (FIGS. 4 and 5) of the stringer tape, and a pair of face and back layers 15,15 of resilient and waterproof elastomer such as natural or synthetic rubber covering opposite surfaces of both the stringer tape 12 and the coupling elements 13, only the face layer 15 being shown in FIGS. 1 and 2. The layers 15,15 are coated or extrusion-molded on the stringer tape 12 and the coupling elements 13. The coupling elements 13 are formed of either synthetic resin by extrusion molding or metal by die casting. Each of the coupling elements 13 includes a pair of upper and lower legs 16 disposed one on each surface of the stringer tape 12, a reduced neck 17 projecting from the legs 16 beyond the longitudinal tape edge 14, and a round coupling head 18 joined to the neck 17.

The slide fastener stringer 11 further has a series of sealing fins 19 (FIG. 1) integral with the face and back layers 15,15 and projecting laterally from the longitudinal tape edge 14 in the plane of the stringer tape 12, each fin 19 extending between the necks 17 of two adjacent coupling elements 13. The sealing fin 19 is made of the same material as that of the layers 15,15 but is thinner than the stringer tape 12 as covered with the layers 15,15. Each of the layers 15,15 includes a groove 20 extending longitudinally of the stringer tape 12 along the length of each row of coupling elements 13 adjacent to the upper or lower legs 16 of the coupling elements 13.

Figure 3:
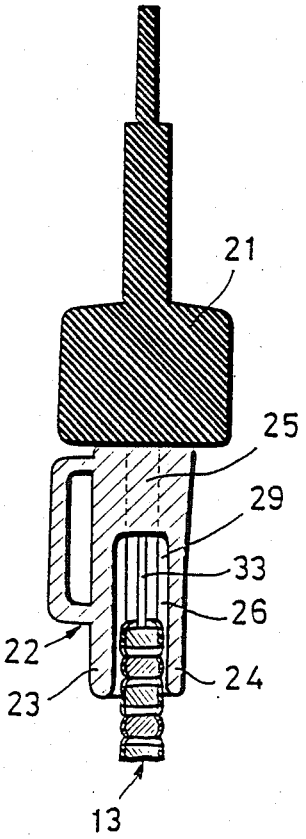
FIG. 3 is a cross-sectional view taken along line III—III of FIG. 2.

A top stop 21 is mounted on and between the stringer tapes 12,12 at a distance from an upper end of the rows of coupling elements 13,13 and interconnects the stringers 11,11. The top stop 21 is made of the same material as that of the layers 15,15 and is thicker than a slider 22. The top stop 21 may be made of synthetic resin or metal coated with a layer of elastomer. The slider 22 has a conventional construction and comprises a slider body including a pair of spaced upper and lower wings 23,24 (FIG. 3) joined at their front or upper end by a neck 25 so as to define therebetween a Y-shaped guide channel 26 for the passage therethrough of the rows of the coupling elements 13,13. Each of the wings 23,24 has a pair of side flanges 27,27 jointly defining a portion of the Y-shaped guide channel 26.

A resilient, bifurcated seal member 28 is mounted on the stringer tapes 12,12 between the upper end of the rows of coupling elements 13,13 and the top stop 21. The seal member 28 is made of the same material as that of the layers 15,15 and has a thickness smaller than the thickness of the coupling elements 13. The seal member 28 includes a pair of elongate resilient tongues 29,30 extending from the end of the respective rows of coupling elements 13,13 along the longitudinal tape edges 14,14 toward the top stop 21 and are joined at their upper end by a narrow head 31 which is integral with the top stop 21 and which extends between the longitudinal tape edges 14, there being defined between the tongues 29,30 and the head 31 an opening or slot 32 facing toward the upper end of the rows of the coupling elements 13,13 for receiving therein the neck 25 of the slider 22. The seal member 28 has a generally segmental shape which is complementary in contour to the Y-shaped guide channel 26 in the slider body.

The seal member 28 has a continuous fin 33 projecting inwardly from opposed inner sidewalls 34,34 of the tongues 29,30 and from the inner wall of the head 31. The fin 33 is made of the same material as that of the fins 19 of the stringers 11,11 and has a thickness substantially equal to that of the fins 19. Each tongue 29,30 has an outer sidewall 35 inclining divergently toward the top stop 21, and an end wall 36 inclining convergently toward the top stop 21 so as to define therebetween a triangular opening slot 37. The sidewalls 35,35 are sealingly engageable with the side flanges 27,27 of the slider 22 when the latter is in its uppermost position shown in FIG. 2. The tongues 29,30 further have, in their outer sidewalls 35,35 adjacent to their respective lower ends, a pair of laterally aligned, semicircular notches 38,38 facing away from each other. One of the tongues 29 has in its inner sidewall 34 a recess 39 opening toward and receptive of the coupling head 18 of the uppermost coupling element **13*a* on the stringer tape 11 on which the other tongue 30 is mounted. The groove 20 also extends along the sidewall 35 and the end wall 36 of each tongue 29,30. The side flanges 27,27 of the slider 22 are received in the grooves 20 when the slider 22 is moved along the coupling elements 13 to and from the top stop 21 so as to close and open the slide fastener 10**.

Figure 5:
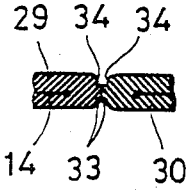
FIG. 5 is an enlarged cross-sectional view taken along line V—V of FIG. 2.

In use, the slide fastener 10 shown in FIG. 1 is closed by manipulating the slider 22 to slide along the coupling elements 13,13 toward the top stop 21. As the slider 21 approaches its uppermost position shown in FIG. 2, the slider's neck 25 is received in the slot or oopening 32 in the seal member 28 and, at the same time, the slider's side flanges 27 engage the outer sidewalls 35,35 of the tongues 29,30 to urge the tongues 29,30 toward each other. During that time, the slots or openings 37,37, and the notches 38,38 in the tongues 29,30 serve to allow the tongues 29,30 to resiliently deform and to smoothly fit in the Y-shaped guide channel 26 in the slider 22. When the slider 22 is in its uppermost position shown in FIG. 2, the slider's neck 25 is sealingly embraced by the fin 33 (FIG. 4) and portions of the fin 33 on the inner sidewalls 34,34 are pressed edgewise together (FIG. 5). The sealing fins 19 of the stringers 11,11 are pressed edgewise against peripheral surfaces of the coupling heads 18 of the opposite coupling elements 13. The coupling head 18 of the endmost coupling element **13*a* is received in the recess 39 in the tongue 29 so that the opposed rows of coupling elements 13 are held into mutual coupling engagement together throughout the length thereof, thus providing a hermetic seal between the opposed stringers 11,11** against water leakage therebetween.

Figure 6:
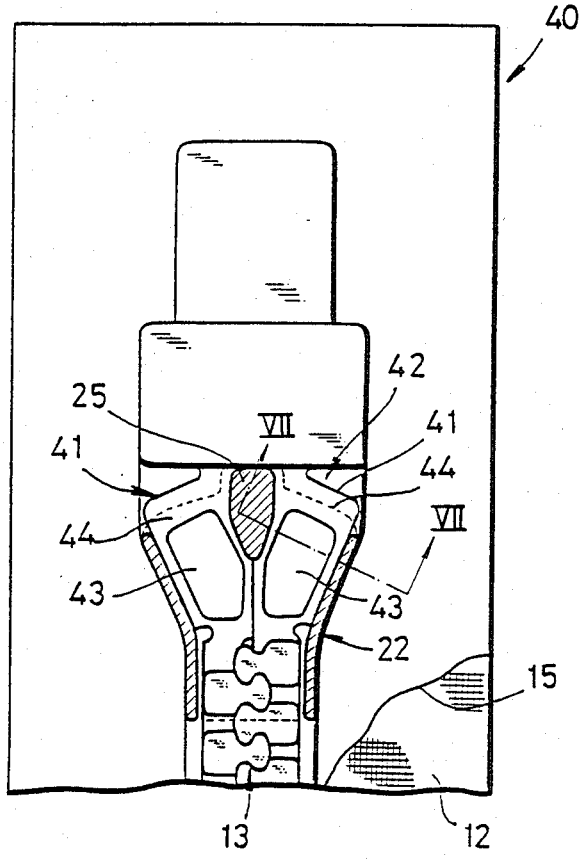
FIG. 6 is a view similar to FIG. 2, showing a modification of the slide fastener.
Figure 7:
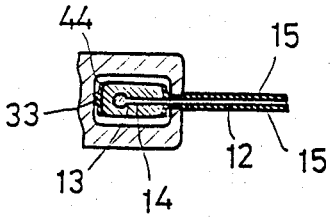
FIG. 7 is a cross-sectional view taken along line VII—VII of FIG. 6.

A modified slide fastener 40 shown in FIGS. 6 and 7 has a construction substantially the same as that of the slide fastener 10 with the exception that each tongue 41 of a resilient seal member 42 has a core 43 made of rigid plastic or metal mounted on the inner longitudinal edge 14 of a stringer tape 12, and a layer 44 of elastomer coated or extrusion-molded around the periphery of the core 43 except at opposite surfaces of the core 43.

Although various minor modifications may be suggested by those versed in the art, it should be understood that I wish to embody within the scope of the patent warranted hereon, all such embodiments are reasonably and properly come within the scope of my contribution to the art.

I claim as my invention:

1. A watertight slide fastener comprising:

(a) a pair of rows of coupling elements mounted on a pair of opposed waterproof stringer tapes along their respective inner longitudinal edges;

(b) a slider having a slider body including a pair of spaced wings joined at their front end by a neck so as to define therebetween a Y-shaped guide channel for the passage therethrough of said rows of coupling elements, each said wing having a pair of side flanges jointly defining a portion of said Y-shaped guide channel; and (c) a resilient bifurcated seal member mounted on said stringer tapes adjacent to one end of said rows of coupling elements and snugly receivable in said Y-shaped guide channel, said seal member having a pair of resilient tongues, respectively, extending from said one end of said rows of coupling elements along said longitudinal tape edges and a head interconnecting said tongues at their upper end so as to define therebetween a first slot facing toward said one end of said rows of coupling elements and snugly, sealingly receptive of said neck of said slider body, said tongues having outer sidewalls sealingly engageable with said side flanges of said slider body and opposed inner sidewalls sealingly engageable together when said slider is in its uppermost position.

2. A watertight slide fastener according to claim 1, said sealing member being made of a resilient and waterproof elastomer.

3. A watertight slide fastener according to claim 1, each said tongue including a rigid core secured to said longitudinal tape edge and a layer of resilient and waterproof elastomer covering said rigid core circumferentially.

4. A watertight slide fastener according to claim 1, said seal member having a fin projecting inwardly from inner sidewalls of said tongues and an inner wall of said head.

5. A watertight slide fastener according to claim 1, said tongues having in their outer sidewalls a pair of laterally aligned notches facing away from each other at their lower end, and a pair of second slots facing laterally away from each other at said upper end.

6. A watertight slide fastener according to claim 1, each said coupling element having a coupling head, one of said tongues having at its lower end a recess opening toward and receptive of said coupling head of the endmost coupling element on said stringer tape on which the other tongue is mounted.

7. A watertight slide fastener according to claim 1, including a top stop mounted on and between said stringer tapes and integral with said head of said seal member.

8. A watertight slide fastener according to claim 7, said top stop being made of resilient and waterproof elastomer.

9. A watertight slide fastener according to claim 1, including face and back layers of resilient and waterproof elastomer covering opposite surfaces of each said stringer tape and said coupling elements, said seal member being integral with said layers.

* * * * *